US006206770B1

(12) United States Patent
Easter et al.

(10) Patent No.: US 6,206,770 B1
(45) Date of Patent: Mar. 27, 2001

(54) WAFER CARRIER HEAD FOR PREVENTION OF UNINTENTIONAL SEMICONDUCTOR WAFER ROTATION

(75) Inventors: William G. Easter; John A. Maze; Frank Miceli, all of Orlando, FL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/376,696

(22) Filed: Aug. 18, 1999

(51) Int. Cl.[7] ..... B24B 7/22
(52) U.S. Cl. ..... 451/288; 451/398
(58) Field of Search ..... 451/290, 41, 288, 451/287, 398, 364

(56) References Cited

U.S. PATENT DOCUMENTS 3,263,375 * 8/1966 Zimmerman ..... 451/398
4,780,991 * 11/1988 Gosis ..... 451/41
5,664,988 * 9/1997 Stroupe et al. ..... 451/288
6,062,953 * 5/2000 Takaya et al. ..... 451/398

FOREIGN PATENT DOCUMENTS

360259372 * 12/1985 (JP) ..... 451/288

* cited by examiner

*Primary Examiner*—Robert A. Rose

(57) ABSTRACT

The present invention provides a method of manufacturing an integrated circuit using a polishing head in a semiconductor wafer polishing apparatus. The polishing head preferably comprises a wafer carrier head and a protuberance coupled to the wafer carrier head. The wafer carrier head has a back surface that contacts the wafer when it is positioned within the carrier head and a carrier ring depends from the carrier head to form an annulus. The annulus has an inner surface, which is typically an inner surface of the carrier ring, and it forms a cavity with the wafer carrier head that is configured to receive a semiconductor wafer therein. The protuberance is located within the annulus proximate the inner surface and is configured to cooperate with a concavity in a periphery of the semiconductor wafer. This cooperation prevents the semiconductor wafer from rotating with respect to the wafer carrier head during polishing of the semiconductor wafer.

9 Claims, 4 Drawing Sheets

WAFER CARRIER HEAD FOR PREVENTION OF UNINTENTIONAL SEMICONDUCTOR WAFER ROTATION

TECHNICAL FIELD OF THE INVENTION

The present invention is directed, in general, to a semiconductor wafer polishing apparatus and, more specifically, to a wafer carrier head designed to prevent accidental rotation of the semiconductor wafer within the carrier head during chemical/mechanical planarization.

BACKGROUND OF THE INVENTION

Chemical/mechanical planarization (CMP) is an essential process in the manufacture of semiconductor chips today. During CMP, the combination of chemical etching and mechanical abrasion produces the required flat, precise surface for subsequent depositions. In the CMP process, the semiconductor wafer is retained in a circular carrier head and pressed against a polyurethane polishing pad covered with a chemical slurry. The pressure exerted on the wafer, the rates of rotation of the platen and the carrier head, the chemical composition of the slurry, the temperature of the environment, and the condition of the polishing pad are all closely controlled. The object is to have a repeatable, consistent process each time so that each wafer is as close as possible to an exact copy of every other wafer.

Therefore, every effort is made in semiconductor manufacture to tightly control all factors of the process in order to insure uniformity of the product. However, one problem has arisen that has not been addressed to date. That is, the semiconductor wafer is retained within the carrier head by a carrier ring that prevents the wafer from exiting the carrier head under the effects of the rotary motion of polishing. The rotation of the carrier head or the rotation of the polishing platen and pad can cause the wafer to exit the carrier head if it is not restrained by the carrier ring. Therefore, these forces may combine to cause the wafer to rotate within the carrier head in a random manner, thereby jeopardizing process repeatability. As each wafer rotates within the individual carrier head at a different rate or amount, the effect is to introduce variability in the CMP process and in the final product. This, of course, increases device failure rates and costs.

Accordingly, what is needed in the art is a device and method for preventing unwanted rotation of the semiconductor wafer within the carrier head during chemical/mechanical planarization.

SUMMARY OF THE INVENTION

To address the above-discussed deficiencies of the prior art, the present invention provides a method of manufacturing an integrated circuit using a polishing head in a semiconductor wafer polishing apparatus. In one embodiment, the polishing head comprises a wafer carrier head and a protuberance coupled to the wafer carrier head. The wafer carrier head has a back surface that contacts the wafer when it is positioned within the carrier head and a carrier ring depends from the carrier head to form an annulus. The annulus has an inner surface, which is typically an inner surface of the carrier ring, and it forms a cavity with the wafer carrier head that is configured to receive a semiconductor wafer therein. The protuberance is located within the annulus proximate the inner surface and is configured to cooperate with a concavity in a periphery of the semiconductor wafer. This cooperation prevents the semiconductor wafer from rotating with respect to the wafer carrier head during polishing of the semiconductor wafer.

Thus, in a broad sense, the present invention provides a way to hold a semiconductor wafer securely in a carrier head so that the wafer does not inadvertently rotate within the carrier head during polishing. This eliminates unwanted variation from wafer to wafer in the results of chemical/mechanical planarization.

In another embodiment, the protuberance may include a pin having a longitudinal axis normal to the wafer backing surface with the pin contacting the inner surface. The pin, in another aspect however, may be movably coupled to the wafer carrier head.

In an embodiment to be illustrated and described, the protuberance is integrally formed with a wafer backing film. The wafer backing film is interposed between the semiconductor wafer and the wafer backing surface during polishing. In yet another aspect, the protuberance is a boss coupled to the inner surface. In one form, the protuberance may comprise an inert material such as: stainless steel, titanium, or platinum. In a further aspect, the protuberance may also comprise a resilient coating, or the protuberance itself comprise a resilient material. In a further aspect of these embodiments, the resilient material may be: polyvinylacetate, polytetrafluoroethylene, or Delrin®. In a particularly advantageous embodiment, the resilient material forms a slurry seal against the semiconductor wafer and the carrier ring.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
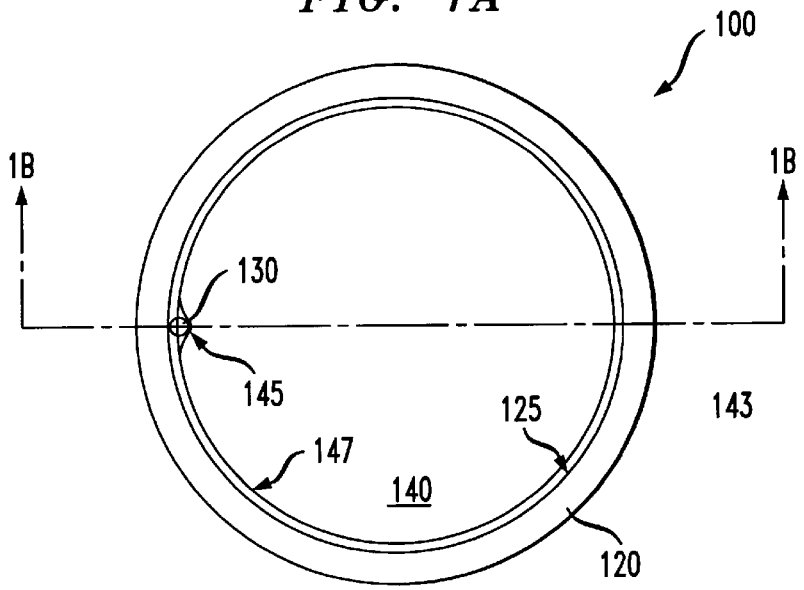
FIG. 1A illustrates a plan view of one embodiment of a semiconductor wafer polishing head constructed according to the principles of the present invention.
Figure 1B:
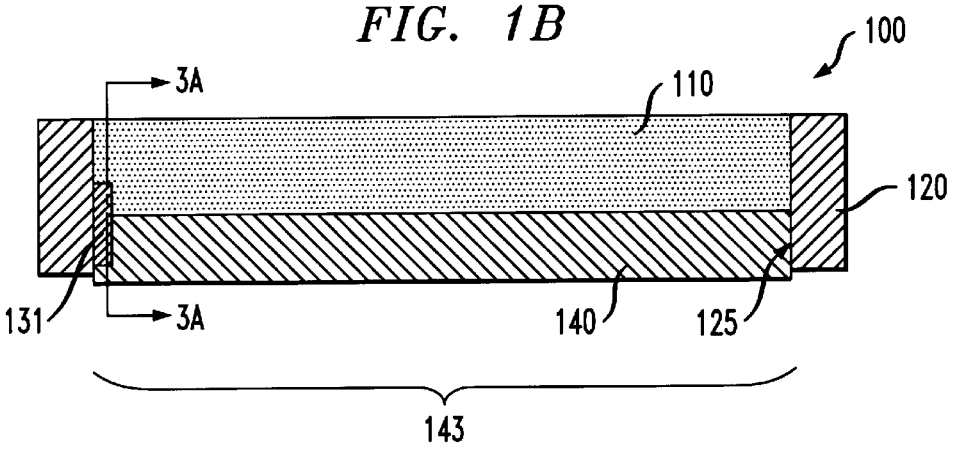
FIG. 1B illustrates a sectional view of the semiconductor wafer polishing head of FIG. 1A along plane 1B—1B.
Figure 1C:
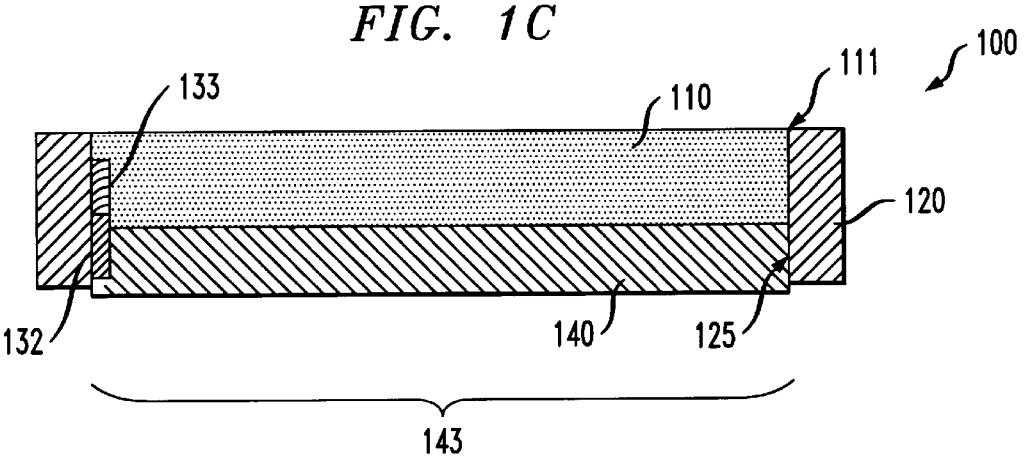
FIG. 1C illustrates a sectional view of an alternative embodiment of the semiconductor wafer polishing head of FIG. 1A along plane 1B—1B.

Referring initially to FIGS. 1A, 1B, and 1C, illustrated are a plan and two sectional views of related embodiments of a semiconductor wafer polishing head 100 constructed according to the principles of present invention. The semiconductor wafer polishing head 100 comprises a carrier head 110, a carrier ring 120, and a protuberance 130. The carrier ring 120 depends from the carrier head 110 at a periphery 111 of the carrier head 110 to form an annulus 120. The carrier ring or annulus 120 has an inner face 125. Therefore, the carrier ring 120 and the carrier head 110 form a cavity 143 that is configured or designed to retain a semiconductor wafer 140 therein. The semiconductor wafer 140 has a concavity 145 in its periphery 147. The protuberance 130 is proximate the inner face 125 so as to cooperate with the concavity 145 to restrain rotary motion of the semiconductor wafer 140 during polishing.

Referring now to FIGS. 1B and 1C, illustrated are sectional views of two alternative embodiments of the carrier head of FIG. 1A along the plane 1B—1B. One who is skilled in the art will realize that the protuberance 130 may be of a variety of shapes and coupled to the carrier head 110 in a variety of ways. For example, in the illustrated example of FIG. 1B, the protuberance 130 is a cylindrical pin 131 that is fixedly mounted to the carrier head 110. The pin 131 may be comprised of an inert material, such as: stainless steel, titanium, or platinum, to minimize the corrosive effects of the chemical component of polishing slurries that are used with the polishing head 100. Of course, the pin 131 may alternatively be formed of a resilient material such as: Delrin® polytetrafluoroethylene (PTFE), or polyvinylacetate (PVA). These materials have excellent chemical resistance to the oxidants of the polishing slurries.

In the alternative embodiment shown in FIG. 1C, the protuberance 130 is a movable pin 132 equipped with an extension spring 133. The movable pin 132 is configured to retract into the carrier head 110 if the semiconductor wafer 140 is placed in the cavity 143 during mounting so that the concavity 145 does not align with the movable pin 132. When the semiconductor wafer 140 is rotated sufficiently to allow the movable pin 132 to align with the concavity 145, the movable pin 132 extends to properly register the semiconductor wafer 140 to the carrier head 110. Of course, in an alternative embodiment, the movable pin 132 and extension spring 133 may be located radially in the carrier ring 120. Alternatively, the movable pin 132 may be hydraulically or pneumatically actuated. Those who are skilled in the art understand how to provide such actuation mechanisms.

Figure 2:
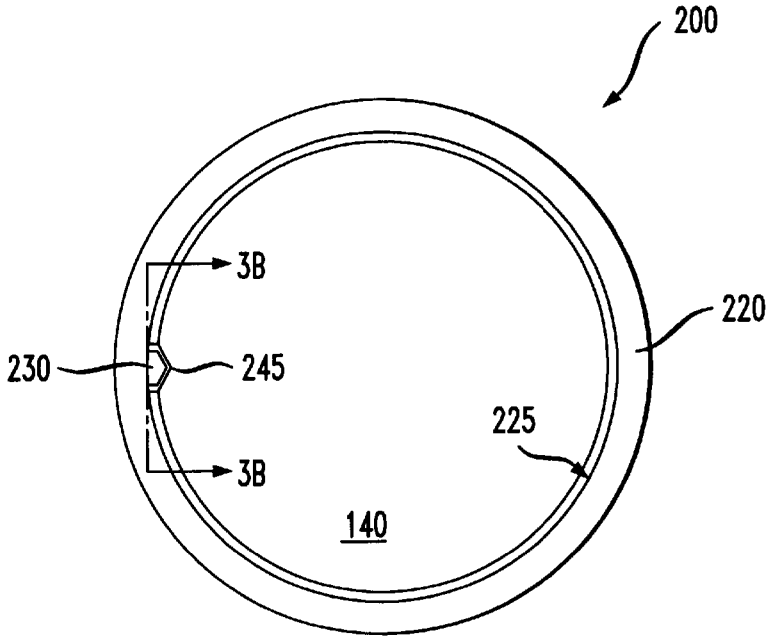
FIG. 2 illustrates a plan view of an alternative embodiment of the semiconductor wafer polishing head of FIG. 1A.

Referring now to FIG. 2, illustrated is a plan view of an alternative embodiment of the semiconductor wafer polishing head of FIG. 1A. In this embodiment, a semiconductor wafer polishing head 200 comprises a carrier head (not visible), a carrier ring 220, and a protuberance 230. The protuberance 230 is in the form of a boss 230 coupled to an inner face 225 of the carrier ring 220. The boss 230 and carrier ring 220 may be integrally formed or assembled as dictated by engineering or monetary concerns. Of course, one who is skilled in the art will immediately recognize that the shape of the boss 230 may be varied as required to readily accommodate a corresponding concavity 245 formed in the periphery of the semiconductor wafer 140.

Figure 3A:
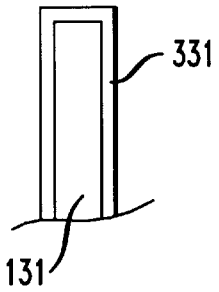
FIG. 3A illustrates a sectional view of the pin of FIG. 1A along planes 3A—3A.
Figure 3B:
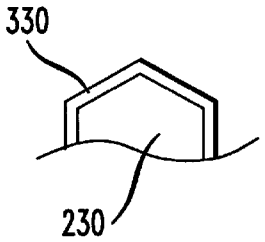
FIG. 3B illustrates sectional views of the boss of FIG. 2 along plane 3B—3B.

Referring now to FIGS. 3A and 3B with continuing reference to FIG. 1A, illustrated are sectional views of the pin of FIG. 1A and the boss of FIG. 2 along planes 1B—1B and 3B—3B, respectively. In these embodiments, the pin 131 further comprises a first resilient coating 331 and the boss 230 further comprises a second resilient coating 330. The resilient coatings 330, 331 may comprise such materials as: PTFE, PVA, or Delrin®. The resilient coatings 331, 330 are sized in relation to the pin 131 or boss 230, respectively, to deform slightly when the semiconductor wafer 140 is placed in the cavity 143. The resilient coatings 330, 331 conform to available space between the wafer 140 and the carrier ring 140 forming a slurry seal.

Figure 4A:
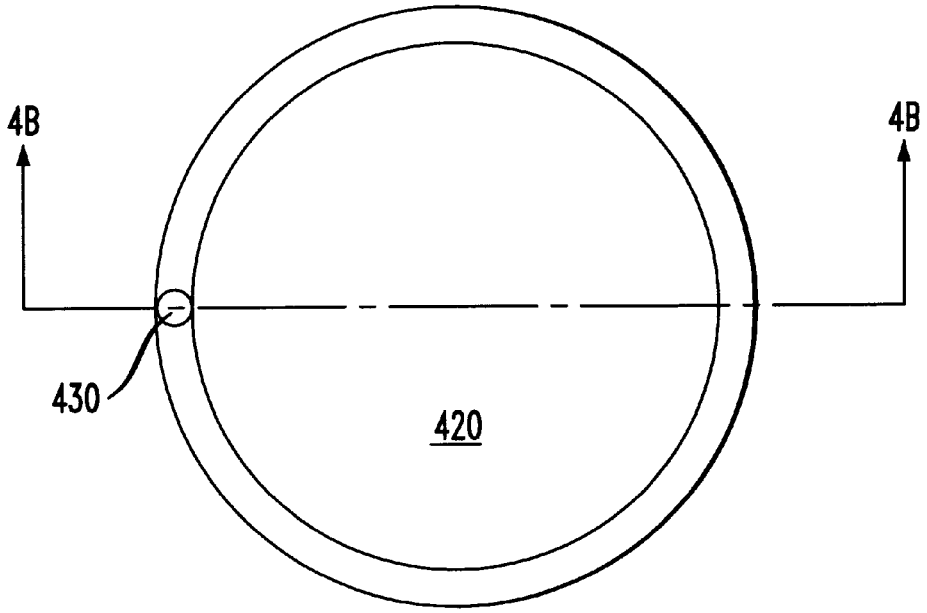
FIG. 4A illustrates a plan view of another alternative embodiment of the present invention.
Figure 4B:
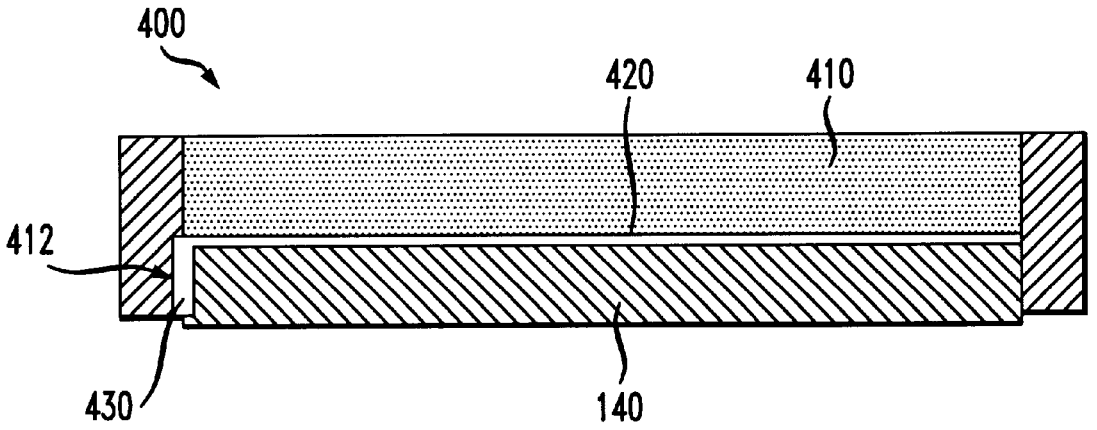
FIG. 4B illustrates a sectional view of the alternative embodiment of FIG. 4A along plane 4B—4B.

Referring now to FIGS. 4A and 4B, illustrated are plan and sectional views of another alternative embodiment of the present invention. A polishing head 400 comprises a wafer carrier head 410, a wafer backing film 420, and a protuberance 430. The wafer backing film 420 and protuberance 430 may be integrally formed of a resilient material such as: PTFE, PVA, or Delrin®. The wafer backing film 420 is placed between the semiconductor wafer 140 and the wafer carrier head 410 when the semiconductor wafer 140 is mounted. The wafer carrier head 410 further comprises a detent 412 in which the protuberance 430 rests when the wafer 140 and wafer backing film 420 are properly mounted. The resilient material serves also as a slurry seal between the wafer carrier head 410 and the semiconductor wafer 140.

Figure 5:
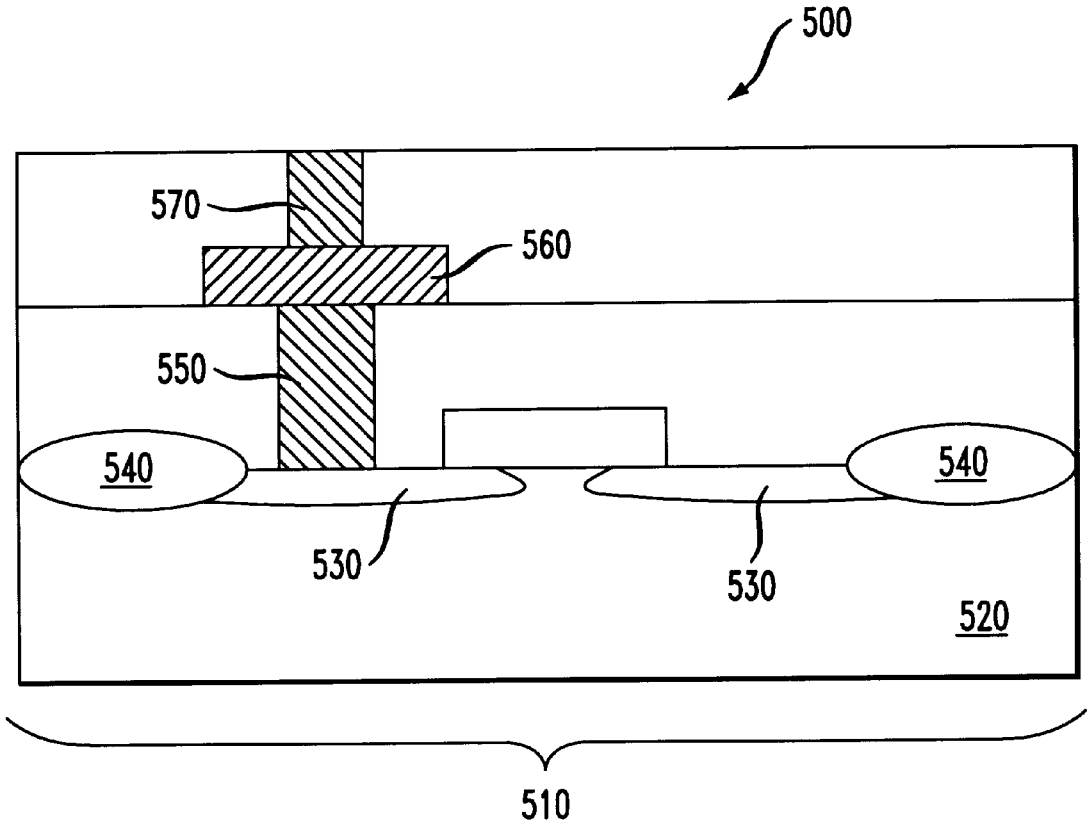
FIG. 5 illustrates a partial sectional view of a conventional integrated circuit that can be manufactured using a semiconductor wafer polishing head constructed in accordance with the principles of the present invention.

Referring now to FIG. 5, illustrated is a partial sectional view of a conventional integrated circuit 500 that can be manufactured using a semiconductor wafer polishing head constructed in accordance with the principles of the present invention. In this particular sectional view, there is illustrated an active device 510 that comprises a tub region 520, source/drain regions 530 and field oxides 540, which together may form a conventional transistor, such as a CMOS, PMOS, NMOS or bi-polar transistor. A contact plug 550 contacts the active device 510. The contact plug 550 is, in turn, contacted by a trace 560 that connects to other regions of the integrated circuit, which are not shown. A VIA 570 contacts the trace 560, which provides electrical connection to subsequent levels of the integrated circuit.

Thus, a semiconductor wafer polishing head has been described that incorporates a protuberance. The protuberance cooperates with a concavity in the periphery of a semiconductor wafer to prevent unwanted rotation of the wafer with respect to the carrier head during wafer polishing.

Although the present invention has been described in detail, those skilled in the art should understand that they can make various changes, substitutions and alterations herein without departing from the spirit and scope of the invention in its broadest form.

What is claimed is:

1. For use with a semiconductor wafer polishing apparatus, a polishing head, comprising:

a wafer carrier head having a wafer backing surface and a carrier ring depending therefrom to form an annulus, the annulus having an inner surface, the wafer carrier head and the carrier ring forming a cavity configured to receive a semiconductor wafer therein; and a protuberance including a pin having a longitudinal axis normal to the wafer backing surface and coupled to the wafer carrier head and located within the annulus proximate the inner surface, the protuberance configured to cooperate with a concavity in a periphery of the semiconductor wafer to prevent the semiconductor wafer from rotating with respect to the wafer carrier head during polishing of the semiconductor wafer.

2. The polishing head as recited in claim 1 wherein the pin is movably coupled to the wafer carrier head.

3. The polishing head as recited in claim 1 wherein the protuberance is integrally formed with a wafer backing film, the wafer backing film interposed between the semiconductor wafer and the wafer backing surface during the polishing.

4. The polishing head as recited in claim 1 wherein the protuberance is a boss coupled to the inner surface.

5. The polishing head as recited in claim 1 wherein the protuberance comprises an inert material selected from the group consisting of:

stainless steel, titanium, and platinum.

6. The polishing head as recited in claim 5 wherein the protuberance further includes a coating comprising a resilient material.

7. The polishing head as recited in claim 1 wherein the protuberance comprises a resilient material.

8. The polishing head as recited in claim 6 or claim 8 wherein the resilient material is selected from the group consisting of:

polyvinylacetate, polytetrafluoroethylene, and

Delrin®.

9. The polishing head as recited in claim 6 or claim 7 wherein the resilient material seals against the semiconductor wafer and the carrier ring.

* * * * *